US007249425B2

(12) United States Patent
Wang

(10) Patent No.: US 7,249,425 B2
(45) Date of Patent: Jul. 31, 2007

(54) SHOE SOLE HAVING SOFT CUSHIONING DEVICE

(76) Inventor: Swei Mu Wang, No. 208-20, Jhongching Road, Situn District, Taichung 40761 (TW)

( * ) Notice: Subject to any disclaimer, the term of this patent is extended or adjusted under 35 U.S.C. 154(b) by 20 days.

(21) Appl. No.: 11/104,020

(22) Filed: Apr. 12, 2005

(65) Prior Publication Data

US 2006/0236563 A1 Oct. 26, 2006

(51) Int. Cl.
*A43B 13/20* (2006.01)
*A43B 13/38* (2006.01)
*A43B 12/12* (2006.01)

(52) U.S. Cl. ..... 36/29; 36/30; 36/44

(58) Field of Classification Search ..... 36/28, 36/29, 44, 141, 43, 30 R
See application file for complete search history.

(56) References Cited

U.S. PATENT DOCUMENTS

| | | | | |
|---|---|---|---|---|
| 4,364,186 A | | 12/1982 | Fukuoka | 36/3 B |
| 4,468,869 A | | 9/1984 | Fukuoka | 36/3 B |
| 4,768,295 A | * | 9/1988 | Ito | 36/28 |
| 4,831,749 A | | 5/1989 | Tsai | 36/3 B |
| 5,086,574 A | * | 2/1992 | Bacchiocchi | 36/35 R |
| 5,694,705 A | * | 12/1997 | Alonso Coves | 36/44 |
| 5,860,229 A | * | 1/1999 | Morgenstern | 36/141 |
| 5,956,869 A | * | 9/1999 | Kim | 36/29 |
| 2004/0221484 A1 | * | 11/2004 | Wang | 36/29 |
| 2005/0268490 A1 | * | 12/2005 | Foxen | 36/28 |

* cited by examiner

*Primary Examiner*—Ted Kavanaugh
(74) *Attorney, Agent, or Firm*—Charles E. Baxley

(57) ABSTRACT

A shoe sole includes a cover layer, and a cushioning member disposed on the cover layer, for softly contacting and engaging with feet of users. The cushioning member may be made of gel, or fluidity materials, or soft materials, or the like. The cover layer includes an opening to partially receive the cushioning member. A basic layer may further be attached to the cover layer, and may include an opening aligned with the opening of the cover layer, to partially receive the cushioning member. The opening of the cover layer includes an area smaller than that of the opening of the basic layer, to anchor and position the cushioning member in the openings of the cover layer and the basic layer.

5 Claims, 4 Drawing Sheets

SHOE SOLE HAVING SOFT CUSHIONING DEVICE

BACKGROUND OF THE INVENTION

1. Field of the Invention

The present invention relates to a midsole or insole or shoe sole for footwear, and more particularly to a shoe sole having a soft cushioning device for providing a shock absorbing effect and for comfortably contacting or engaging with the feet of the users.

2. Description of the Prior Art

Various kinds of typical sports shoes have been developed and provided for jogging, running or other sport purposes, and comprise two basic requirements. The principal task of the shoe is to help or to facilitate running or walking, and to allow runners to move easily. The other task of the shoe is to protect the feet from running exertion, so that runners' optimum performance may be preserved or maintained in races. In addition, in a consumer's point of view, longer life of a shoe sole is preferred. To achieve the aforementioned functions, many different shoe soles have been developed.

Suitable or required resilience of shoe soles can be obtained in many different ways. For example, a traditional shoe sole is made of foamable materials for providing a suitable elasticity, and a rubber layer is combined with the foamable material for protecting the foamable material. However, the resilience or the cushioning effect of the foamable materials and the rubber layer is not good enough, and the feet of the users may not be comfortably contacted or supported with the foamable materials and/or the rubber layer of the shoe sole.

Another traditional shoe sole includes an air cushion structure. However, the cost of air cushioned shoe sole is high and the procedure of manufacturing is complicated. In addition, sometimes, unnecessary deformations may take place in the shoe soles of air cushion structure. Accordingly, a shoe sole with sufficient and proper elasticity as well as long life and comparatively low cost of manufacture is needed.

U.S. Pat. No. 4,364,186 to Fukuoka, U.S. Pat. No. 4,468,869 to Fukuoka, and U.S. Pat. No. 4,831,749 to Tsai disclose three of the typical ventilated footwears, each including a series of openings formed therein, for air cushioning purposes. However, the openings are deeply formed within the shoe portion by such as molding or mold injection processes, and thus the feet of the users also may not be comfortably contacted or supported with the foamable materials and/or the rubber layer of the shoe sole.

The present invention has arisen to mitigate and/or obviate the afore-described disadvantages of the conventional shoe soles.

SUMMARY OF THE INVENTION

The primary objective of the present invention is to provide a shoe sole including a soft cushioning device for providing a shock absorbing effect and for comfortably contacting or engaging with the feet of the users.

In accordance with one aspect of the invention, there is provided a shoe sole comprising a cover layer, and a cushioning member disposed on the cover layer, for softly contacting and engaging with feet of users.

The cushioning member is made of gel, or may be made of fluidity materials, or soft materials, or the like.

The cover layer includes an opening formed therein to partially receive the cushioning member. The opening of the cover layer preferably includes a U-shape or a horseshoe-shape.

A basic layer may further be provided and attached to the cover layer, and may include an opening formed therein and aligned with the opening of the cover layer, to partially receive the cushioning member. The opening of the cover layer includes an area smaller than that of the opening of the basic layer, to anchor and position the cushioning member in the openings of the cover layer and the basic layer.

Further objectives and advantages of the present invention will become apparent from a careful reading of the detailed description provided hereinbelow, with appropriate reference to the accompanying drawings.

DETAILED DESCRIPTION OF PREFERRED EMBODIMENT

Figure 1:
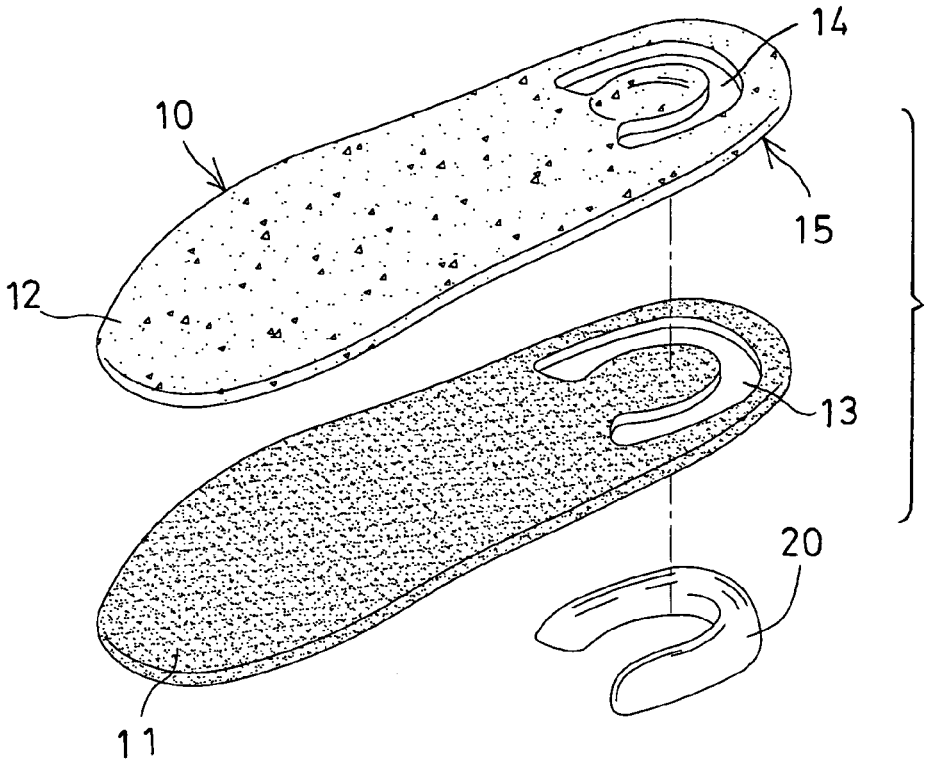
FIG. 1 is an exploded view of a shoe sole in accordance with the present invention.
Figure 2:
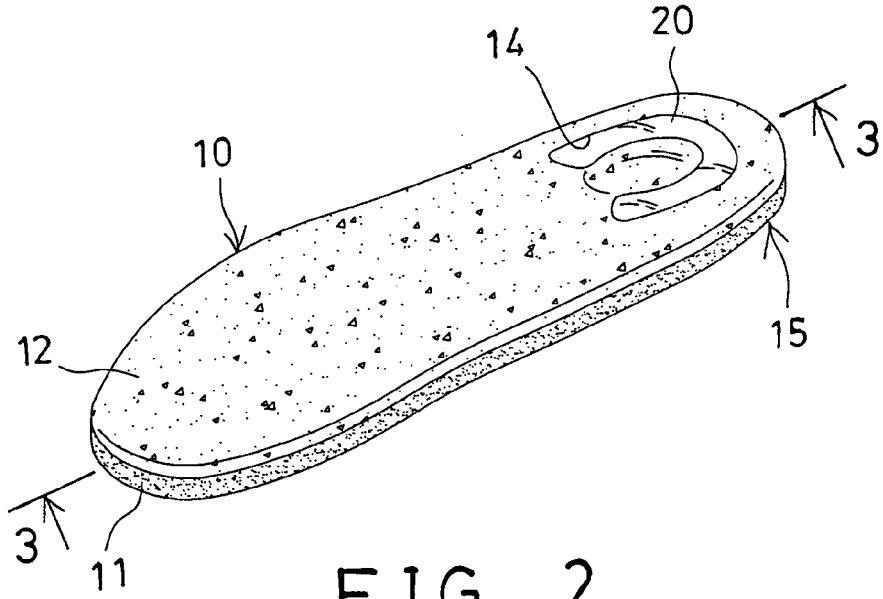
FIG. 2 is a perspective view of the shoe sole.
Figure 3:
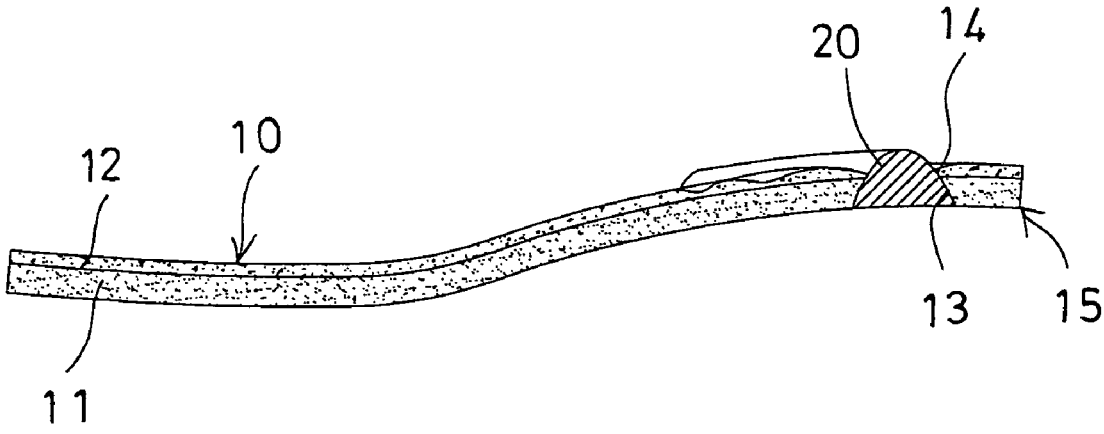
FIG. 3 is a cross sectional view of the shoe sole, taken along lines 3-3 of FIG. 2.
Figure 7:
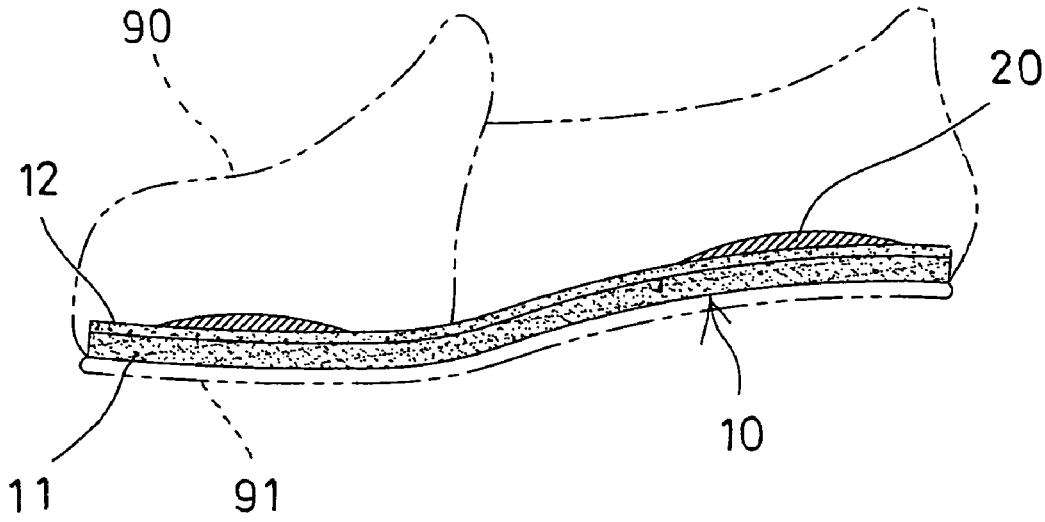
FIG. 7 is a cross sectional view taken along lines 7-7 of FIG. 5.

Referring to the drawings, and initially to FIGS. 1-3, a midsole or insole or shoe sole 10 in accordance with the present invention is provided for attaching to bottom of a shoe 90 (FIGS. 7, 8), and is arranged to be engaged or disposed above an outsole 91, or between the outsole 91 and an insole (not shown), for forming and for providing a shock absorbing effect to the shoe 90.

Figure 5:
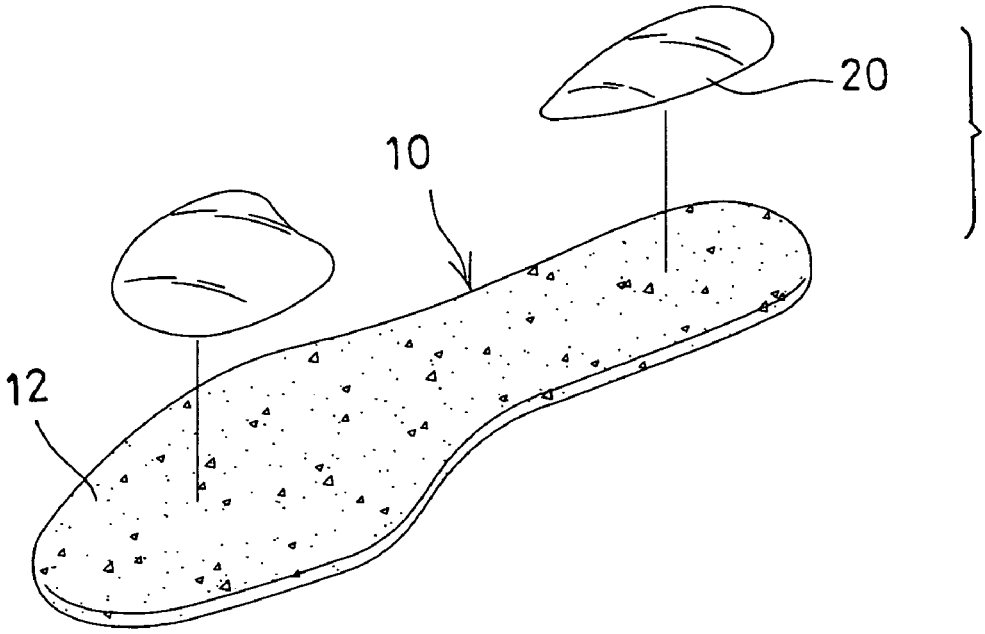
FIG. 5 is an exploded view illustrating another arrangement of the shoe sole.
Figure 6:
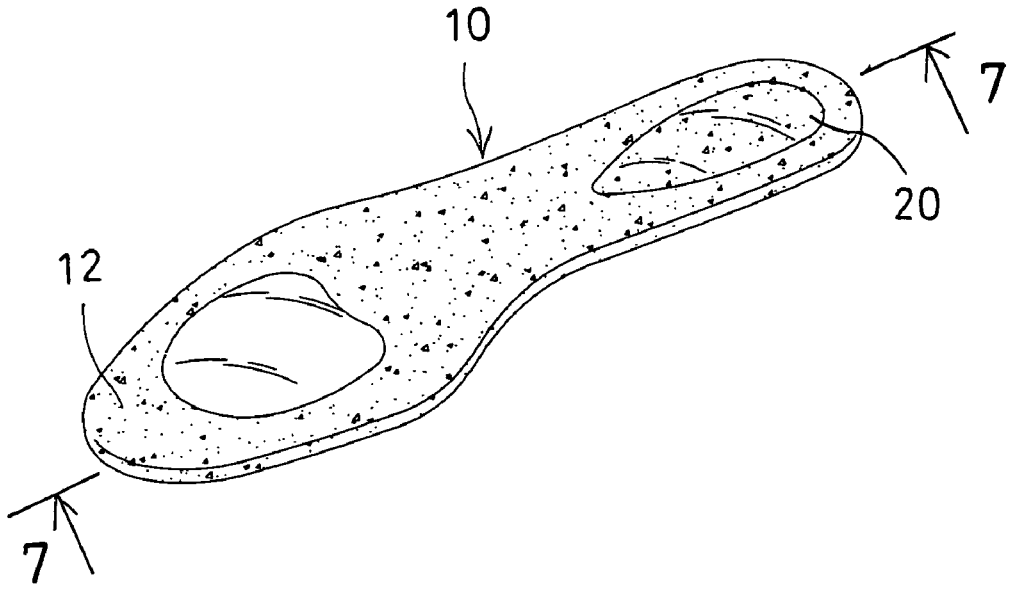
FIG. 6 is a perspective view of the shoe sole as shown in FIG. 5.

The midsole or insole or shoe sole 10 comprises one or more layers 11, 12 which may be made of foamable materials, rubber materials, or other synthetic materials, or the like. For example, the shoe sole 10 may include a single layer 12 as shown in FIGS. 5 and 6, or two or more layers 11, 12, such as a basic layer 11 and a cover layer 12, as shown in FIGS. 1-4 and 7-8, and may include a suitable resilience or softness for comfortably contacting or engaging with the feet of the users.

The shoe sole 10 further includes one or more openings 13, 14 formed in either or each of the layers 11, 12, particularly formed in the heel portion 15 of the layers 11, 12 of the shoe sole 10. It is preferable that the opening 14 of the cover layer 12 is aligned with the opening 13 of the basic layer 11, but has a relatively smaller size or diameter or peripheral portion or area than that of the opening 13 of the basic layer 11. For example, the openings 13, 14 of the layers 11, 12 may include a U-shape or horseshoe-shape, or other shapes.

Figure 8:
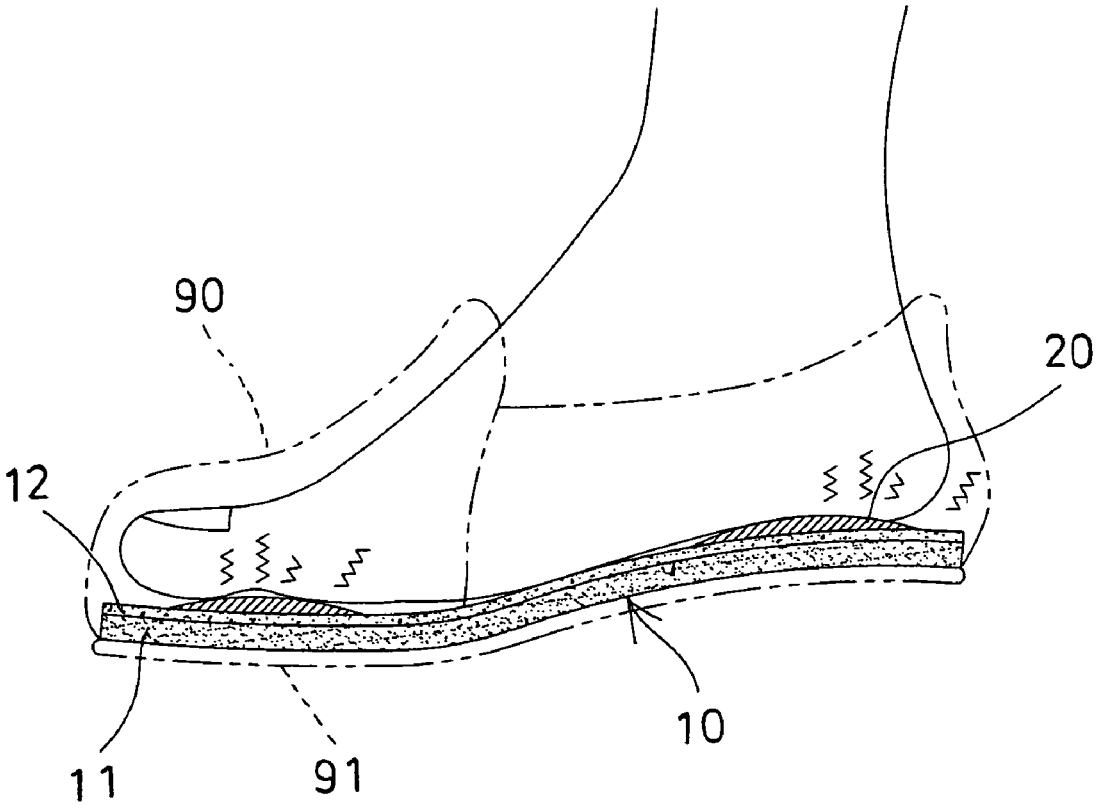
FIG. 8 is a cross sectional view similar to FIG. 7, illustrating the operation of the shoe sole.

The shoe sole 10 further includes a cushioning member 20 partially disposed or engaged in the openings 13, 14 of the layers 11, 12 of the shoe sole 10, and extended upwardly beyond the cover layer 12, for softly and comfortably contacting or engaging with the feet of the users, as shown in FIG. 8. The cushioning member 20 is preferably made of fluidity or soft materials, such as gel, or uncured or unheated polyurethane materials, or the like.

It is to be noted that the fluidity or soft materials for forming the cushioning member 20 include an excellent resilience or deformability or softness, for resiliently and softly and comfortably contacting or engaging with the feet of the users, and for providing a suitable cushioning effect to the feet of the users.

As described above, the opening 14 of the cover layer 12 includes a relatively smaller size or diameter or peripheral portion or area than that of the opening 13 of the basic layer 11, for allowing the cover layer 12 to engage with the cushioning member 20, and to anchor and to position the cushioning member 20, and thus to prevent the cushioning member 20 from being disengaged from the basic layer 11 and the cover layer 12 of the shoe sole 10.

Figure 4:
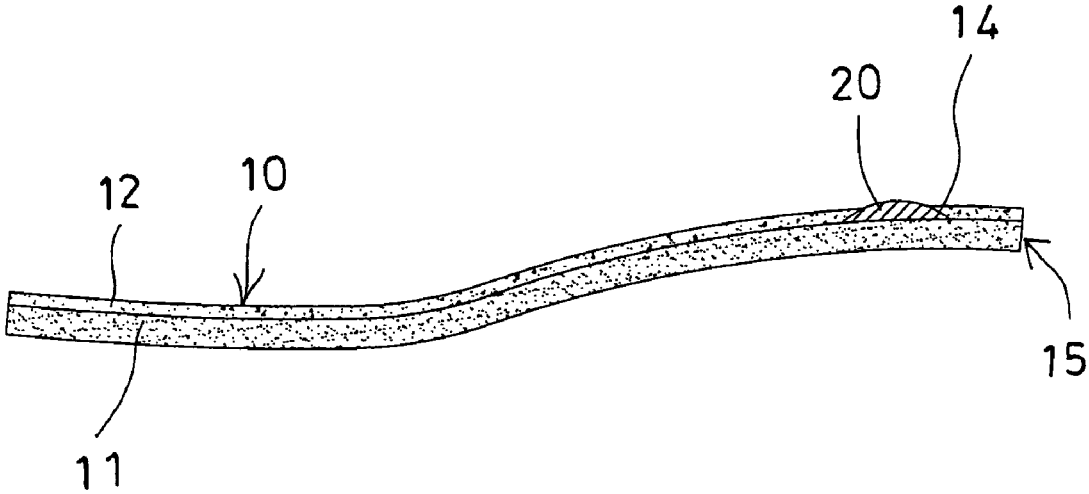
FIG. 4 is a cross sectional view illustrating a further arrangement of the shoe sole.

Alternatively, as shown in FIG. 4, the cushioning member 20 may be attached or secured onto the basic layer 11, and partially disposed or engaged in the opening 14 of the cover layer 12 of the shoe sole 10, and extended upwardly beyond the cover layer 12, for softly and comfortably contacting or engaging with the feet of the users.

Further alternatively, as shown in FIGS. 5-8, the cushioning member 20 may also be directly attached or disposed on the cover layer 12, and thus extended upwardly beyond the cover layer 12, for softly and comfortably contacting or engaging with the feet of the users.

The provision of the cushioning member 20 on the shoe sole 10 may provide an excellent elasticity or softness or resilience to the shoe sole 10, to softly and comfortably contact or engage with the feet of the users, without forming or providing air chambers or air bladders within the shoe sole 10 as those disclosed in the typical shoe soles.

Accordingly, the shoe sole in accordance with the present invention includes a soft cushioning device for providing a shock absorbing effect and for comfortably contacting or engaging with the feet of the users.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A shoe sole comprising:

a cover layer including an opening formed therein, said opening of said cover layer including a U-shape, a basic layer attached to said cover layer, said basic layer including an opening formed therein, and said opening of said basic layer including a U-shape and aligned with said opening of said cover layer, and a cushioning member disposed on said cover layer, and partially engaged into said opening of said basic layer and partially engaged into said opening of said cover layer for softly contacting and engaging with feet of users.

2. The shoe sole as claimed in claim 1, wherein said cushioning member is made of gel.

3. The shoe sole as claimed in claim 1, wherein said cushioning member is made of fluidity materials.

4. The shoe sole as claimed in claim 1, wherein said cushioning member is made of soft materials.

5. The shoe sole as claimed in claim 1, wherein said opening of said cover layer includes an area smaller than that of said opening of said basic layer, to anchor and position said cushioning member in said openings of said cover layer and said basic layer.

* * * * *